US006089936A

United States Patent [19]

Hoffman

[11] Patent Number: 6,089,936

[45] Date of Patent: Jul. 18, 2000

[54] PERSONAL FLOATATION DEVICE

[76] Inventor: Richard S. Hoffman, 6749 SW. 166 Dr., Pembroke Pines, Fla. 33331

[21] Appl. No.: 09/263,350

[22] Filed: Mar. 5, 1999

[51] Int. Cl.[7] ..... B63C 9/08

[52] U.S. Cl. ..... 441/117; 441/118; 441/123

[58] Field of Search ..... 441/106, 117, 441/118, 123, 125, 126, 127

[56] References Cited

U.S. PATENT DOCUMENTS

| | | | |
|---|---|---|---|
| 3,727,249 | 4/1973 | Bonthelius | 441/123 |
| 4,272,857 | 6/1981 | Oldham | 441/123 |
| 4,619,623 | 10/1986 | Elverskog | 441/123 |
| 5,775,967 | 7/1998 | Lacoursiere et al. | 441/117 |

*Primary Examiner*—Stephen Avila
*Attorney, Agent, or Firm*—Malloy & Malloy, P.A.

[57] ABSTRACT

A personal floatation device comprising an improved float to provide buoyant lift to the body of the wearer of the device when in water and a strap assembly to connect the improved float about the wearer. The improved float includes a front sized to generally overlay the front torso of a wearer, a head support to generally overlay the shoulder region, and a neck opening sized to loosely confront the neck of the wearer, with a portion of the neck opening disposed in the front and in the head support, and further, includes an inner neck contacting surface about a perimeter of the neck opening. The improved float includes a back sized both to overlay a portion of the back of a wearer and dwell at least partially within the neck opening, with the back being movably connected to the head support and movable between a first position wherein it dwells within the neck opening and another position wherein the neck opening is fully opened to permit a wearer's head to pass therethrough. On a wearer, the back assumes another position wherein the neck opening is partially opened and characterized by a reduced inner diameter. The improved float is connected about a wearer's body by the strap assembly, and in water, buoyant lift forces are applied to the upper body of the wearer, and in particular, to the back and head support so as to support, cradle and more safely orient the wearer's head while in water, with the neck opening being sized to comfortably surround the neck.

26 Claims, 7 Drawing Sheets

PERSONAL FLOATATION DEVICE

BACKGROUND OF THE INVENTION

1. Field of the Invention

The present invention is directed to a personal floatation device having an improved float. More in particular, the present invention includes an improved float and a strap assembly to connect the float to a wearer and thereby apply buoyant forces or lift to the body of a wearer in water. The float is structured to comfortably support the head of the wearer above water level and to tend to orient the head into a face-up attitude while the wearer of the device is in water, without being lifted over the chin and off the head of the wearer by the buoyant forces being applied by the water. Further, the improved float is capable in a preferred embodiment of being converted into a seat cushion with a seat back to provide more comfortable seating on a boat or other location including a sporting or stadium event, and the like.

2. Description of the Related Art

Various types of life vests or personal floatation devices exist which are designed to be worn or otherwise used by a person to keep that person afloat in a body of water. Such floatation devices, also referred to as marine buoyant devices, are currently in wide use in the recreational, commercial and military areas. In addition, floatation devices having certain performance characteristics are a legal requirement in the operation of boats and ships of various sizes.

The United States Coast Guard ("USCG") has established guidelines for determining the performance level of a life vest or personal floatation device ("PFD"), based on the life saving capacity of such devices. For instance, Underwriters Laboratories, Inc., which is understood by the inventor hereof to be an approved testing agency for the USCG, lists several categories of "Buoyant Devices" in its Mar. 29, 1996 handbook entitled "UL 1123 Standard for Marine Buoyant Devices," which is incorporated herein by reference. One of these categories is for a Type I device, also referred to as an "off-shore" PFD which is intended to turn most unconscious wearers face up in the water and which is best suited for open, rough or remote water where rescue may be slow in coming. There is also a Type II device, sometimes also referred to as a "near shore" PFD, which is "intended to turn some unconscious persons from a face down position in the water to a position where the wearer's respiration is not impeded." These PFDs are good for calm, inland water or where there is a good chance of fast rescue. Other categories of PFDs include a Type III device, which is "intended to support a conscious person in the water in an upright position . . . [or backward position but] is not required to turn an unconscious person in the water from a face-down position to a position where the wearer's respiration is not impeded." As such, a Type III device is not suitable for an unconscious wearer because a wearer may have to tilt his or her head back to avoid going face down in the water, and further, his or her face may often be covered by waves. There is also a Type IV device, which is "intended to be thrown to and grasped by a person in the water" and which does not need to provide any means for closely fitting about the person's body. Of course, the Type IV device is also not suitable for an unconscious person, but also not even for a non-swimmer, as such devices require a person to hold on for buoyant support.

In addition, the United States Coast Guard ("USCG") subjects PFDs to certain "tests" such as the "Donning Test," wherein the PFD must be capable of being donned in a short period of time, usually one minute or less, and a "Flotation Stability Test," to name a few. There are others, such as a "freeboard test", which measures a distance perpendicularly from the surface of the water to lowest point where the wearer's respiration may be impeded, a "head support" test, a "face plane angle" test, and a "chin support" test, with specific criteria for passing such tests. As one might imagine, to qualify as a Type I or a Type II device, there is also a "turning test." Of course, several PFDs or personal floatation devices have been developed which meet the various testing and other criteria of the USCG for the foregoing "Types" of devices.

The USCG requires that approved PFDs be available on a boat, although the number and type depend on the number of people on board, the size and type of boat, and the kind of boating. Of course, a PFD can only be helpful in a emergency on the water if it is readily available. As one never knows when an emergency situation will arise, it would naturally be best for persons who are out on the water or on a boat to wear a PFD at all times. The USCG's booklet entitled "Think Safe Choose the Right Personal Flotation Device (PFD)" reports that most drownings do not occur way out at sea, but instead, that nine (9) out of ten (10) drownings occur in inland waters. Given this fact, and a choice among the various "Types" of PFDs, it would be preferable for recreational boaters and the like on inland waters to carry at least Type II PFDs on board, and further, to wear such PFDs at all times.

There has, however, been a persistent problem in the art relating to the comfort of a Type II PFD when it is being worn by a person both in and out of the water, which makes doing so impractical. Presumably, this is also true of Type I PFDs as well, although this discussion will refer more to Type II PFDs. More in particular, with all of the known Type II PFDs, there is a tendency for the PFD to "ride up" from the intended position about the torso of the wearer and to not just contact, but to apply pressure to the skin about the neck, jaw and/or chin of the wearer, especially when he or she is immersed in water. As the skin and muscles about one's neck, chin, and even at the base of the skull are sensitive, if not tender, this causes discomfort, particularly if the PFD is worn in water for more than just a short period of time. In addition, this tendency of known PFDs to ride up and become bunched about the neck and chin of the wearer restricts one's ability to talk freely and comfortably. In addition, Type II PFDs tend to cause discomfort when worn outside of the water, tending to dig into the back of the neck of wearer. This is particularly apparent when the wearer gets out of the water because the device is much heavier.

In recognition of this, the inventor hereof has long worked on providing a solution to this problem and others in the art of PFDs, which has resulted in the development of two PFDs, for which U.S. patents have been granted to the inventor hereof. One such patent, U.S. Pat. No. 4,472,151, discloses a device having a buoyant front panel, a buoyant pair of spaced shoulder embracing elements, and a buoyant rear support panel defined by a backrest portion and a headrest portion, and a strap assembly to connect these panels about a wearer. However, experience has shown the PFD disclosed in this patent to suffer from certain disadvantages. For example, the approach of this patented device in addressing the tendency of a PFD to ride up and apply pressure about the wearer's neck and chin focused on providing support and cushioning under the arms of a wearer. This device, however, is fairly complicated in its construction, and further, requires components which are not already accepted by the U.S. Coast Guard and/or testing agencies approved by the U.S. Coast Guard, and consequently, it is expensive to manufacture, assemble and effectively bring to market. In addition, this patented device, which also converted into a seat back for use at a sporting event so as to offer a more usable device, fell short of qualifying as a Type I or Type II floatation device. Further, this patented device did not meet certain other criteria deemed desirable by the inventor hereof, such as qualifying as a "Universal Size Device," which the USCG uses to refer to an adult floatation device intended for use by persons in the thirty inch (30") to fifty-two inch (52") chest size.

The other is U.S. Pat. No. 4,871,338, which discloses a personal floatation device having a plurality of buoyant material panels which substantially encircle the wearer, a head support portion, and an improved strap assembly. While this patented PFD is more simple in its construction, the plurality of buoyant panels encircling the wearer still resulted in its being relatively expensive to manufacture and assemble. In addition, this patented PFD relied primarily upon the strap assembly being snugged closely about the body of the wearer in order to not ride up and apply pressure about the neck and chin of the wearer. The disadvantage associated with this PFD, however, was that if the strap assembly were not snugged closely or tightly enough about the wearer, the PFD would not only ride up, but would not pass certain of the USCG tests for a Type II device, such as the chin support test, which requires that the PFD be in direct contact with the wearer's jawline when the wearer is in either the vertical upright or relaxed face-up position or that the PFD prevent the wearer from touching his chin to his chest while in the relaxed face-up position.

Accordingly, there remains a need in the art for a PFD which not only meets the life saving criteria of the U.S. Coast Guard for a Type II device, but which is comfortable to wear and which does not put any undue pressure under or around the neck area of the wearer, especially when he or she is immersed in water, but also when he or she is not immersed in water, in order to encourage the wearing of a PFD at all times during an outing on a water craft. Ideally, any such PFD should permit the wearer to talk freely, even when immersed in water. Any such PFD should also be relatively simple in its construction, inexpensive to manufacture, and capable of enabling a person to determine easily how to don the PFD, so that it may be readily donned in a short period of time. It would also be ideal if any such PFD were developed to also be convertible into a seat cushion and seat back, so that the PFD would be more likely to be used and readily available at all times during an outing on a water craft. Finally, any such PFD should be properly positioned on the wearer in order to provide adequate floating support in an evenly distributed manner to the body of the wearer in water, and further, should accomplish all of these objectives without requiring that the straps or other mechanism which mounts the PFD to the wearer's body be unduly snug about the wearer's body.

SUMMARY OF THE INVENTION

The present invention is designed to address and present a solution to these and other needs which remain in the art of personal floatation devices or PFDs. More specifically, the present invention is directed to a personal floatation device having an improved float and a strap assembly to connect the float about a wearer. The improved float includes a head support cushion sized and configured to support, cradle and orient the head of at least some wearers in a face-up attitude while the wearer is in water, once strapped about a wearer, and is thought to otherwise meet the testing criteria of the U.S. Coast Guard ("USCG") for at least Type II flotation devices, and possibly, for Type I flotation devices, as well.

More in particular, the improved float comprises a front sized to generally overlay the front chest of a wearer, and a neck opening formed therein which is preferably sized to permit the wearer to pass his or her head therethrough. The improved float also comprises a head support cushion, which may be integrally formed with and/or operably connected to the front, and further, which is structured and configured to cradle and tend to orient the head of a wearer into a face-up attitude when the float is worn by a wearer immersed in water. The improved float also includes a buoyant back or flap structure, which is sized to generally overlay the upper central part of the back of a wearer, and further, which is swingably connected to the front.

Preferably, the swingable back or flap structure is sized and configured to dwell substantially, if not completely, within the neck opening of the front of the float in what may be defined as a first position. With the back of the float in this first position, wherein the back occupies the space within the neck opening, the float front, back and head support cushion all assume a generally flat or planar orientation, which is helpful for purposes of shipping and storage, or even for use as a seat cushion by one rowing a boat or otherwise. The back, however, is movable out of the first position, away from the neck opening and toward at least a second position in which the neck opening is fully opened, such that a person may pass his or her head through the neck opening and don the float. When the float is being worn by a wearer, the back of the float assumes another position wherein the back generally confronts the upper, central back region of the wearer, and in this third position, the size of the neck opening is effectively reduced, such that the neck opening loosely confronts the neck of a wearer and the float is thereby prevented from being lifted off the head of the wearer. More in particular, the back of the float is connected to the front of the float in a manner so that a portion of the back occupies the space within the neck opening when the float is being worn, which thereby, reduces the inner diameter of the neck opening, and this feature is believed by the inventor hereof to permit the PFD of this invention to pass the USCG's chin support test, described previously herein for a Type II flotation device.

In one embodiment, the front and head support cushion of the improved float may be constructed from a single piece of a suitable buoyant material, as discussed in greater detail hereinafter, with a neck opening formed therein and a back hingedly connected or otherwise movably connected or coupled thereto. In a more preferred embodiment, however, the float is formed with a plurality of separate pieces. For example, the front and head support cushion of the float may comprise two separate members, ideally sized and configured to be joined together to form a neck opening therebetween. In this more preferred embodiment, one end of the back is swingably mounted to the float generally adjacent an upper region of the neck opening, and further, the separate front and head support cushion are collectively jacketed within an envelope or "yoke" of a brightly colored, cloth-like material so as to reliably join the float together. Alternatively, the front and head support cushion may be individually jacketed in an envelope of such material with other suitable means for joining them together, such that the head support cushion can be folded or bent somewhat at the juncture of the front and head support cushion. In this more preferred embodiment, the front and head support cushion of the float can be moved relative to one another, ideally into a generally perpendicular orientation, and thereby, render the float usable as a seat cushion, with a seat back, for more comfortable seating on a boat or other location. This capability of being converted into a seat cushion and seat back, in combination with the more comfortable structure of the float generally, should result in the device's being more widely used on a boat, rather than just being stowed away below deck. This, in turn, should cause the device of the present invention to be more readily accessible in the event of an emergency on the water.

The present invention is also directed to a personal floatation device or PFD which incorporates the improved float, and as such, includes a strap assembly for connecting the float about a wearer. In the preferred embodiment, the strap assembly comprises a girth strap which interconnects the float front and the swingable back and which is adjustable to snug or tighten the float about the wearer's torso region. Ideally, the strap assembly includes a pair of strap segments, each secured to one side surface of the float, which are structured and disposed to facilitate a proper connection of the float about the wearer, comfortable use of the float as a seat cushion, and convenient stacking of a plurality of improved floats. In addition, the strap assembly will ideally include a pull tab connected to the back of the float in order to assist a person with moving the back out of the first, stored position wherein the neck opening is closed. The strap assembly is preferably structured and disposed to facilitate a person's donning of the float once the back of the float has been moved to second the position, wherein the neck opening is fully opened, ideally without any blocking of to the neck opening. Preferably, the strap assembly is also structured and disposed to maintain the float, in its most preferred embodiment, in the generally perpendicular orientation suitable for use as a seat cushion, with a seat back, for more comfortable seating on a boat, at a sporting event or other location.

In the preferred embodiments, the improved float of the present invention is structured to be a pullover type, intended to be donned like a pullover sweater. In alternative embodiments, however, the improved float may be a "vest" type or even a "jacket" type, in which case, a slit may be provided in the front of the float, which can be opened or closed. In either the vest or jacket type embodiments, suitable fastener means which are well-known in the art may be provided, such as a plurality of buttons or snaps, a hook and loop type of fastener such as Velcro, or even a zipper, to close the slit and thereby, help to temporarily secure the device about the upper torso of a wearer.

In other preferred embodiments, the front of the float includes a pocket structure on the outer surface thereof, which can further serve to help a person in donning the float or PFD correctly and quickly in an emergency situation, because the front is easily identified by the pocket structure. Of course, the pocket structure is preferably waterproof in its construction in order that personal identification documents or other small personal and/or emergency items such as a small flashlight, credit card, keys, money, etc. might be more safely carried therein. Further, the outer surface of the front of the float may also include indicia thereon, which is of a further aid to a wearer to readily identify the front of the float.

Accordingly, a general object of the present invention is to provide a personal floatation device of the type which embodies an improved float and a strap assembly for maintaining the float about the body of a wearer.

It is also a general object of the present invention to provide a personal floatation device which urges the face of the head of a wearer into a face-up attitude while he or she is afloat in a body of water, and which otherwise meets the testing criteria of the United States Coast Guard for Type II flotation devices, at a minimum.

A primary object of the present invention is to provide such a personal floatation device which has a neck opening in it through which the head of a wearer can pass, but which is sized to loosely and comfortably confront the neck of the wearer while the device is being worn.

It is also a primary object of the present invention to provide a personal floatation device which is structured and disposed to have the inner diameter of the neck opening of the float reduced when the device is being worn by a person, and to tend to maintain that reduced inner diameter of the neck opening when the person is immersed in water, in order to avoid the inadvertent removal of the device over the chin and off the head of the wearer.

Another important object of the present invention is to provide a personal floatation device which can be oriented for use as a seat cushion with a generally perpendicular seat back to offer comfortable seating on a boat, a bench or other support surface such as might be found at an arena, stadium or the like.

Still another important object of the present invention is to provide a personal floatation device having an improved strap assembly that facilitates a person's donning of the device in a short period of time, as might be required if one is faced with imminent danger.

Yet another object of the present invention is to meet the foregoing objects while providing a float and floatation device which is relatively simple in its design and construction, which utilizes components that are already approved by the U.S. Coast Guard or its authorized testing agencies, and which can, therefore, be manufactured and assembled at a relatively low cost.

These and other objects, features, and advantages of the present invention will become more apparent from the detailed description of the preferred embodiments of the invention, set forth below.

BRIEF DESCRIPTION OF THE DRAWINGS

In accordance with the foregoing summary and objects, features and advantages of the invention, the invention will now be described with reference to the accompanying drawings in which:

FIG. 2-B is a perspective view of the floatation device shown in FIG. 1, converted for use as a seat cushion and seat back.

FIG. 2-C is a rear perspective view of the floatation device illustrated in FIG. 2-B.

DESCRIPTION OF THE PREFERRED EMBODIMENTS

Figure 1:
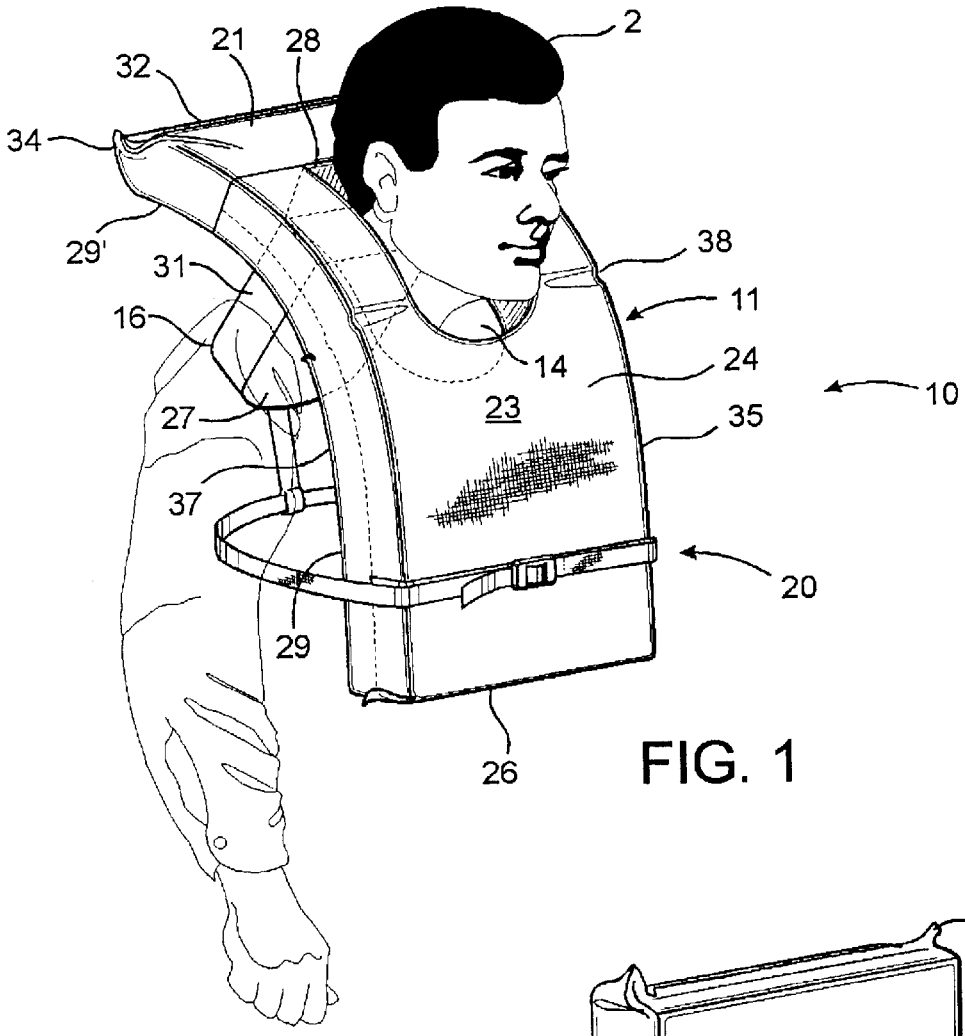
FIG. 1 is a perspective view of a more preferred embodiment of the personal floatation device according to the present invention, as worn by a person.

As shown throughout the drawings, and with particular reference to FIG. 1, the present invention is directed to a personal floatation device, indicated generally by the reference numeral 10, and in general, comprises an improved float 11 and a strap assembly 20 to connect the improved float 11 about a wearer 2. As will become more clear from the following description, the floatation device 10 is structured and disposed to be properly positioned on the wearer in order to provide adequate floating support in an evenly distributed manner to the body of the wearer 2, when the wearer is in a body of water, and further, to tend to orient the head of the wearer in an attitude wherein the wearer's face is up and out of the water. As such, the personal floatation device 10, is designed to meet the criteria of the United States Coast Guard, described previously herein, for at least Type III Personal Floatation Devices (PFDs), and preferably, also for Type II and Type I PFDs.

Figure 2A:
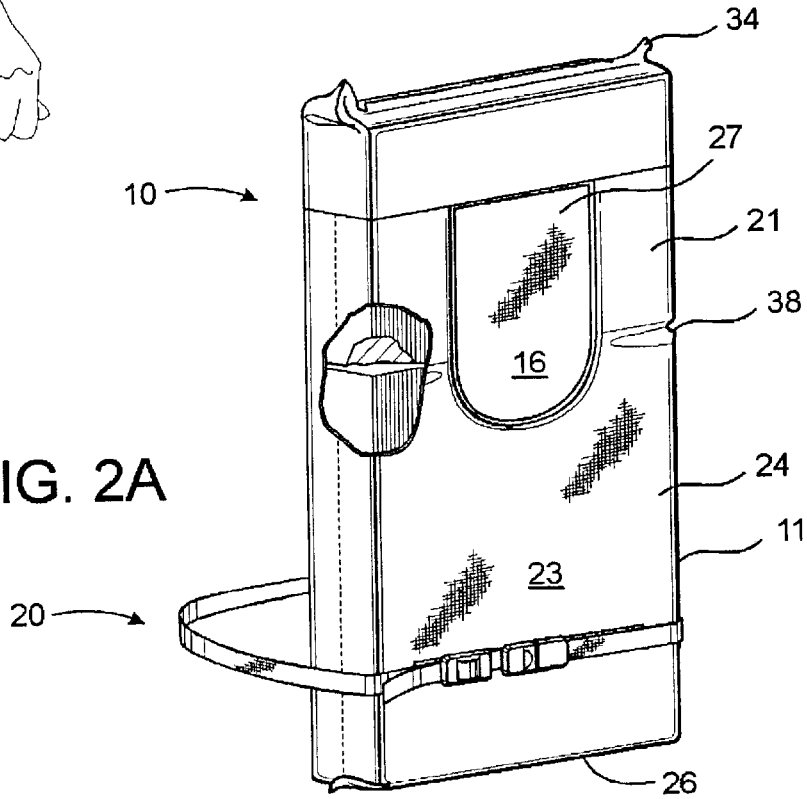
FIG. 2-A is a perspective view in partial cut-away of the personal floatation device seen in FIG. 1.
Figure 2B:
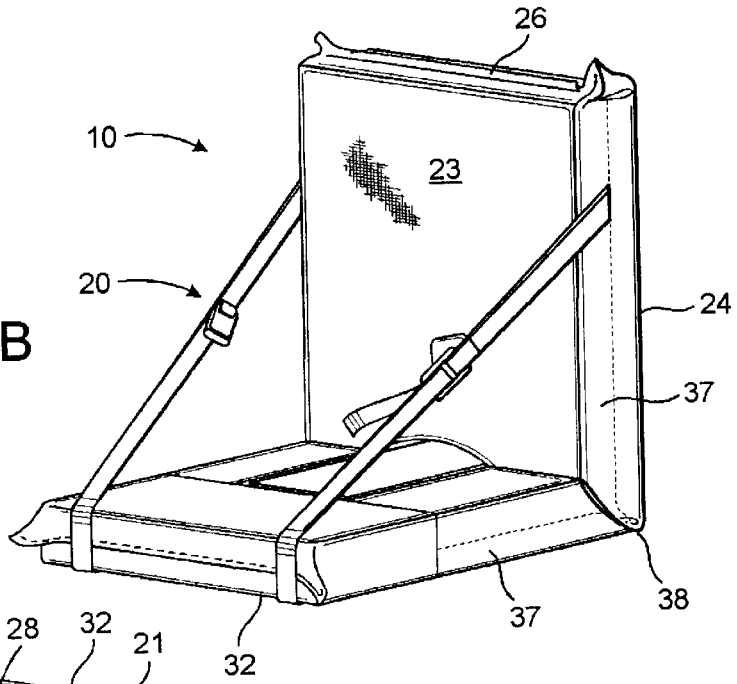
Figure 3:
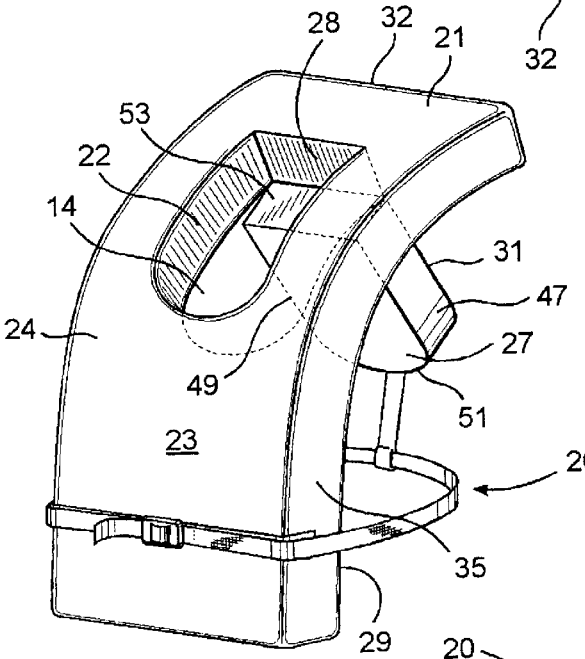
FIG. 3 is a perspective view of an alternative embodiment of the floatation device according to the present invention.
Figure 2C:
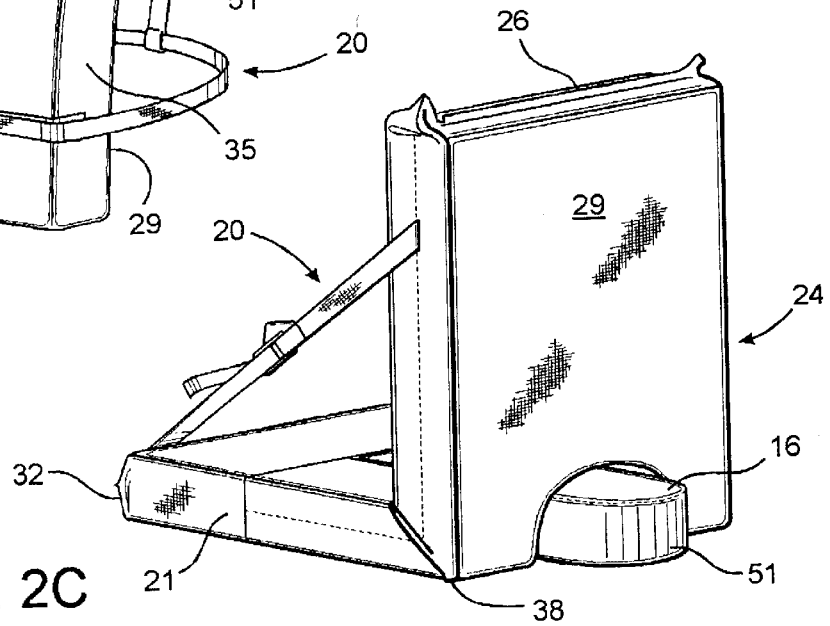

The improved float 11 of the present invention is formed of a buoyant material and as illustrated in FIG. 1, is preferably sized and configured to generally correspond and confront the chest and shoulder region of the wearer 2. With reference to FIG. 3, the float 11 may be comprised of a single piece of buoyant material, such as, but not limited to, a poly-vinyl chloride (PVC) material dipped or coated in a rubber material. Preferably though, and as illustrated in FIGS. 1, 2-A through 2-C, and 4–11, the float 11 is comprised of at least two separate, interconnected portions of buoyant material, namely, a front 24 and head support cushion or cradle 21. With reference to FIG. 1, the front 24 of the float 11 includes an inner main surface, 29, which confronts and generally contacts the upper torso of the wearer and a visible, outer main surface 23, as well as a first end surface, 26, a second, spaced apart end surface, 32, and a pair of spaced side surfaces, 35 and 37. In this more preferred embodiment, wherein the float 11 is formed of two, separate and interconnected portions, the front 24 preferably extends a first distance from the first end surface 26 toward the second end surface 32 to a bendable or weakened zone 38, described in more detail below, with the inner main surface 29 thereof being generally sized and configured to confront the front torso of the wearer. The head support cushion or cradle 21 preferably extends a second distance from generally adjacent the front 24 and the bendable or weakened zone 38, to the second end surface 32, with the outer main surface 23 thereof being generally sized and configured to confront the rear of the head of the wearer. In either of these embodiments, the improved float 11 is preferably of an elongate, parallelepipedal shape or a panel like appearance, and may be covered with a plastic or other waterproof material.

The buoyant material utilized to form the float 11 may be any suitable buoyant material known in the art, although it will preferably be a "unicellular" or closed cell foamed polymeric material, such as but not limited to polyethylene, and may even be comprised of a plurality of foam material sheets or layers. As such, the buoyant material will preferably have cushiony and somewhat bendable characteristics, but also, will be capable of providing at least 15 and ½ pounds-force of buoyancy or lift when included within a personal floatation device to be worn by a person weighing over 90 pounds-mass. In addition, the personal floatation device 10 of the present invention, and in particular, the improved float 11 and strap assembly 20, is preferably sized to qualify as a "Universal Size Device", which is defined by Underwriter Laboratories in its booklet mentioned previously, as an adult device intended for use by persons with a chest size in the range of between thirty inches (30") and fifty-two inches (52").

Figure 9:
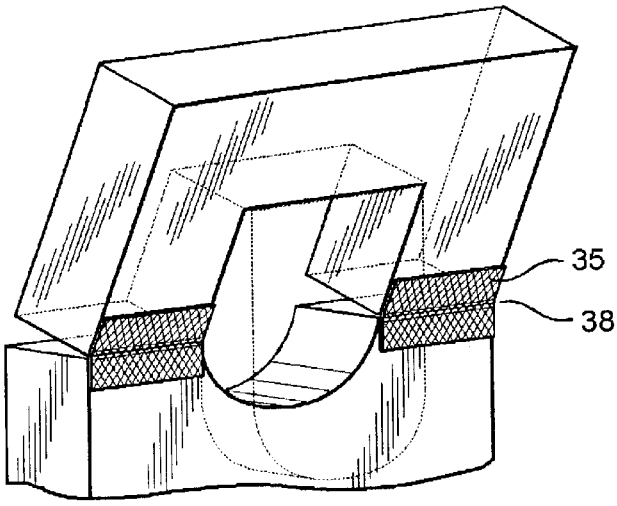
FIG. 9 is a partial view of an improved float according to the present invention illustrating an alternative means of connecting the front and head support cushion of the float.
Figure 10:
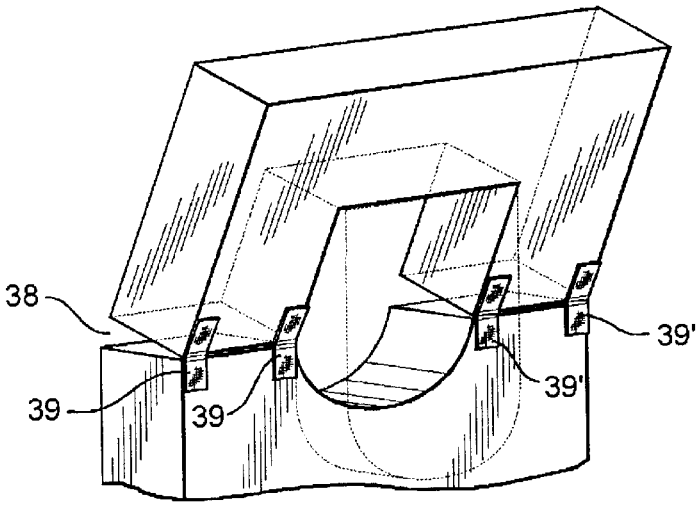
FIG. 10 is a partial view of an improved float illustrating yet another alternative means of connecting the front and head support cushion of the float.
Figure 11:
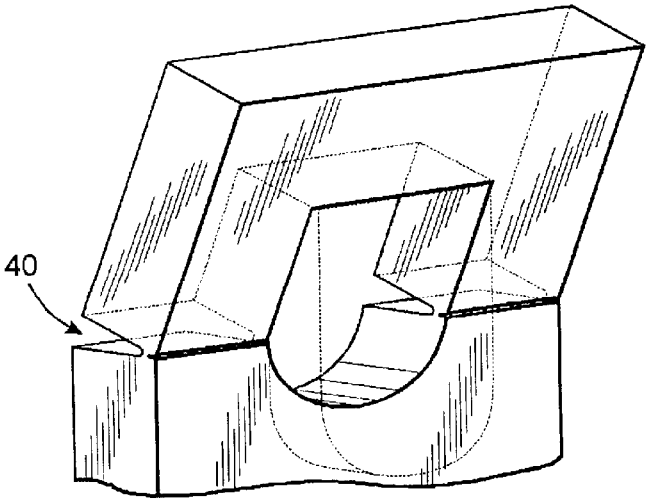
FIG. 11 is also a partial view of an improved float but illustrating a weakened zone in the front of the float to promote bendability of the float relative to a head support cushion.

In addition, the float 11 may be covered or jacketed in a yoke or material, 34, which in a preferred embodiment is a single envelope of bendable material, such as, but not limited to, a nylon or other sturdy cloth-like material. In the embodiment wherein the float 11 is formed of at least two separate portions, namely and preferably, the front 24 and the head support cushion or cradle 21, these portions may be separately jacketed and connected together to form a bendable zone 38 between the jackets, which again, are preferably of nylon or another suitable covering material. Alternatively, the front 24 and head support cushion or cradle 21 may be separately jacketed and connected by other means, such as a web 35, see FIG. 9, or shoulder straps, such as 39 and 39', may be utilized for this purpose, as shown in FIG. 10. When not in use, preferably the front 24 and the head support cushion or cradle 21 are normally disposed, end to end in a generally flat, coplanar relationship, which is helpful for purposes of shipping and storage of the present invention, although it might also be utilized in this orientation as a seat cushion within a boat, such as for sitting on the bench of a row boat. However, this preferred, bendable embodiment of the invention is also helpful to orient the float 11 as a seat cushion with a seat back for use at a stadium or sporting event and the like, which will be described hereinafter in greater detail. In the case wherein the float 11 is made of a plastic material in the relatively rigid range, such as a PVC material, a weakened zone 40 may be provided to render it bendable, that is to say, the front 24 and head support cushion or cradle 21 are bendable relative to one another, as illustrated in FIG. 11. The weakened zone 40, as shown in FIG. 11, may also result from a zone with a plurality of closely adjacent parallel slits.

Figure 13:
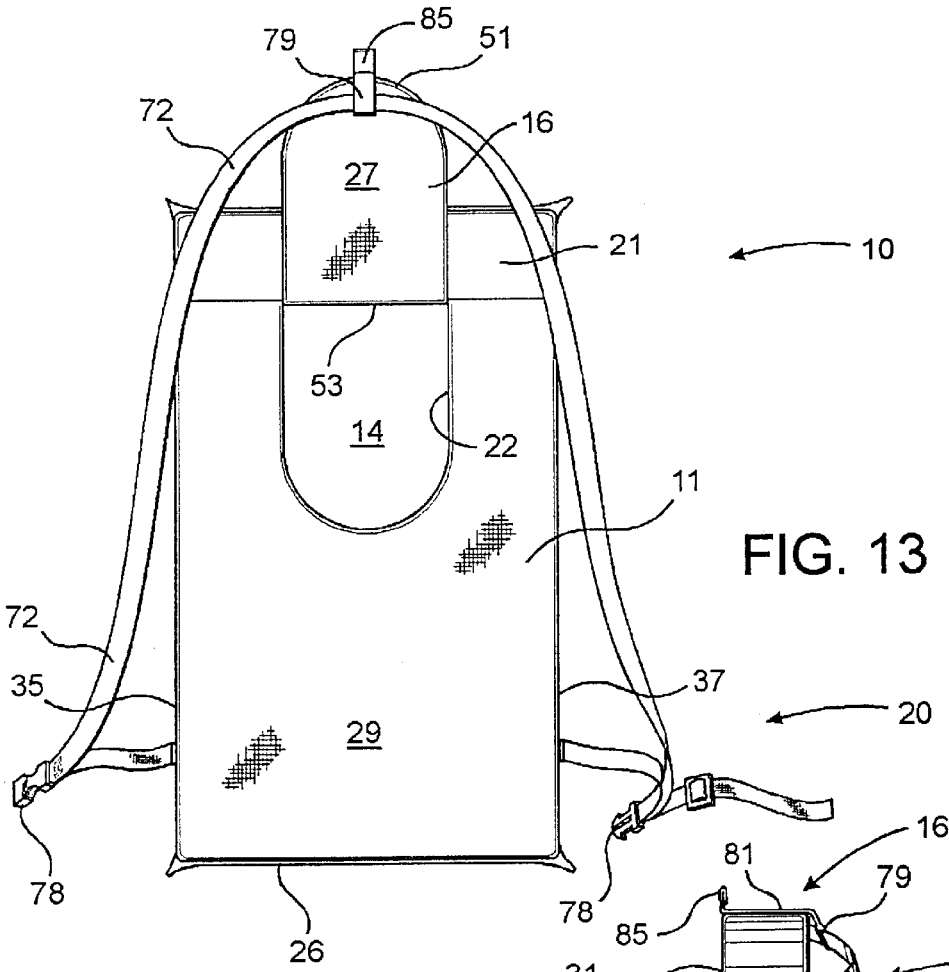
FIG. 13 is a rear view of the flotation device seen in FIG. 12, illustrating the back of the float in a fully open orientation and the preferred strap assembly when the back of to the float is in this orientation.
Figure 14:
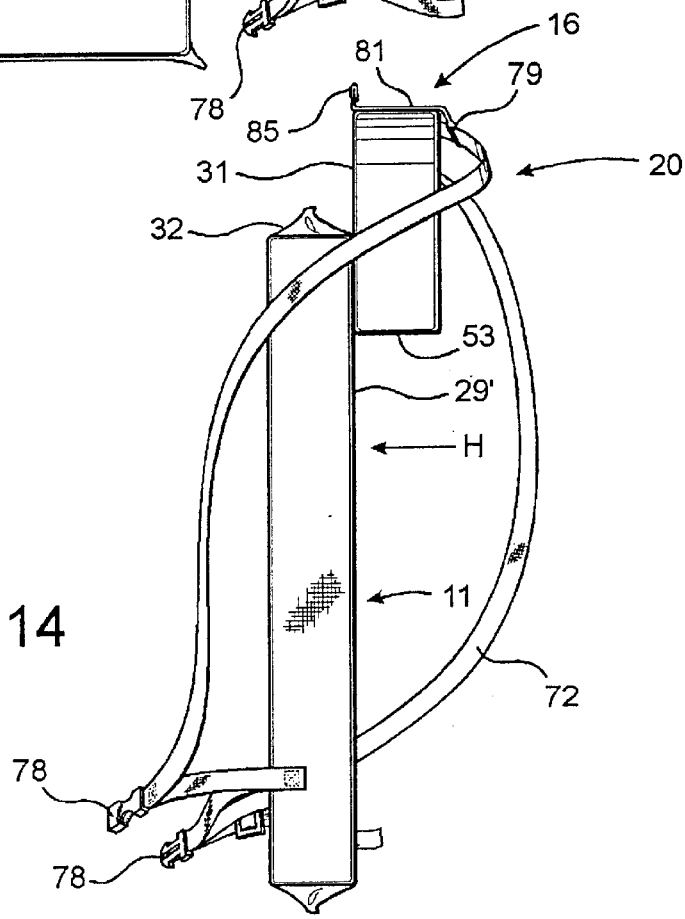
FIG. 14 is a side view of the flotation device seen in FIG. 13.

As is perhaps best illustrated with reference to FIG. 3, the float 11 of the present invention includes a neck opening or aperture 14. The neck opening 14, defines a recess surface 22, and is preferably located closer to the second end surface 32 than to the first end surface 26 of the float 11. Further, the neck opening 14 is preferably sized and configured to permit snug passage of a wearer's head therethrough, which as to be described hereinafter, occurs when the float 11 is disposed in a fully opened position as shown in FIGS. 13 and 14. After a person has so donned the float 11, the neck opening 14 of the present invention will effectively have a reduced inner diameter, as will also be described hereinafter, causing the neck of the wearer to be loosely and comfortably engaged when the PFD 10 is being worn, especially when the wearer is immersed in water. As illustrated in the drawings, the neck opening 14 is most preferably formed within float 11 to have a generally "U" shape, and in the embodiment wherein the float 11 is comprised of two separate float portions, the neck opening 14 is formed by a generally semi-circular portion in the front 24 and a generally inverted "U" shaped portion in the head support cushion or cradle 21.

Figure 4:
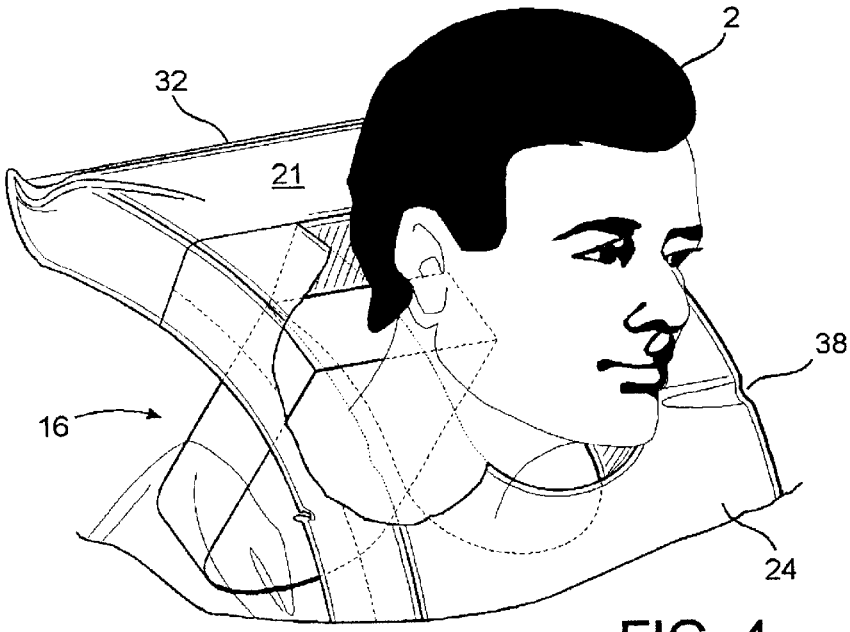
FIG. 4 is a enlarged perspective view of the preferred embodiment of FIG. 1, to further illustrate the upper portion of the improved float.

As illustrated throughout the various Figures, the improved float 11 of the present invention also includes a back 16, which might also be referred to as a flap structure. The back or flap structure, 16, is also formed of a buoyant material, preferably the same material as that forming the float 11, and the back 16 can also be covered by an envelope of nylon or other suitably strong, yet bendable material. Preferably, the back or flap structure 16 is sized and configured to dwell substantially, if not completely, within the neck opening 14, so as to close it and occupy the space within it, at least partially, if not completely. Most preferably then, but not necessarily, the back 16 is structured and configured to lie in generally co-planar, aligned relation with the float 11 when it is disposed within the neck opening 14. It should be noted that this feature renders a PFD which is capable of being utilized on airplanes as when its parts are disposed in a generally co-planar orientation, the float can be fitted inside the aircraft seat back, with it being known to provide some of such seat backs with means for accessing the flotation device. Ideally, the back 16 is also symmetrical about an imaginary center line thereof, as is the generally "U" shaped portion of the float 11 about the neck opening 14, is generally "U" shaped as well, and is of a significantly smaller dimension than that of the float 11. In particular, the back 16, which includes an inner surface 31, an outer surface 27, end surfaces 51 and 53, and spaced side surfaces 47 and 49, is preferably sized and configured generally so that in use, the outer surface 27 confronts an upper, central portion of the wearer's back, when the device 10 is worn, see FIGS. 1, 4 and 12.

In addition, the back 16 is preferably connected and/or interconnected to the float 11 in a manner which permits relatively swingable movement of the back 16 relative to the float 11. For example, many suitable types of hinge assemblies are known and many of these may be utilized for movably interconnecting the back 16 and the front 24 of float 11. Preferably, however, the hinge assembly is formed by securely sewing together the nylon or other cloth like material envelope jacketing the back 16, and the float 11 at the surface 22 of the neck opening 14, adjacent the second end surface 32. As perhaps is best shown in FIG. 3, the hinge assembly is most preferably disposed at the juncture of the inner surface 28 of the head support cushion or cradle 21 and the outer surface 31 of the back 16, adjacent or at end 53 thereof. As is about to be described, the preferred hinge assembly will permit the back 16 to move between at least three positions, namely, a first or closed position wherein the back 16 dwells at least partially, if not completely within the neck opening 14 of the float 11 shown in FIG. 2-A, and a second or fully opened position shown in FIGS. 13 and 14, to permit snug passage of the head of a wearer through the neck opening 14 in order to don the device, and a third position, generally maintained when the device is being worn by a wearer, shown in FIGS. 1, 4 and 12, wherein the inner diameter of the neck opening 14 is reduced by the end surface 53 of the back 16, as shown in FIG. 3.

More in particular, and as best illustrated in FIG. 3, when the personal floatation device 10 of the present invention is worn by a wearer, the back 16 is moved and disposed away from, but not completely out of the neck opening 14. That is, the neck opening 14 formed within the float 11 is not completely opened, and in fact, has a reduced inner diameter given the preferred manner and location of the back's 16 attachment to the float 11. From FIG. 4, it can also be noted that when the personal floatation device is being worn by a wearer 2, the back 16 assumes a position wherein it overlays the central portion of the back of the wearer, while the inner surface 29 of the float front 24 confronts the upper front torso of the wearer. With reference to FIG. 14, it should also be noted that the back 16 is also preferably capable of being swingably moved generally about one hundred and eighty degrees (180°) from the first position within the neck opening, into a second position, wherein the outer surface 31 of the back 16 is disposed in close confronting relation to the inner surface 29' of the head support cushion or cradle 21 of the float 11, causing the neck opening 14 to be fully opened and to readily permit a wearer to don the device. On the other hand, when the back 16 is disposed in the neck opening 14, it is most preferably, but not necessarily, fully closed. When worn, the neck opening 14 of the device 10 is partially closed, with the end surface 53 of the back 16 partially blocking the neck opening 14, as may be observed in FIG. 3, and effectively, reducing the inner diameter of the neck opening 14. Thus, when the device is worn, and the front 24 and the back 16 are drawn by the strap assembly 20 snugly about a wearer, the surface 22 within the neck opening 14 is loosely and comfortably disposed about the neck of a wearer, 2, and further, because of the reduced inner diameter of the neck opening 14, shown in FIG. 3, the float 11 is not easily lifted over the head of the wearer, as there is not enough clearance for the chin to pass in this orientation. Further, when a wearer of the device 10 is immersed in water, it is believed that buoyant forces are applied to the back 16, and in particular, to the end 51 of the back 16, and this force, in turn, is directed to end 53 of the back 16, as well as indirectly to the head support cushion or cradle 21. From the drawings, it should be clear that this force causes end 53 of the back 16 to confront and contact the base of the head and neck of the wearer, 2, as well as the head support cushion or cradle 21 to contact the lower back region of the wearer's head, which both serve to provide cushioned support therefor.

The present invention is also directed to a strap assembly 20 in order to connect the improved float 11 about a wearer and thereby, render a personal floatation device (PFD) which meets the criteria of the U.S. Coast Guard for at least a Type III PFD, and preferably, for both Type II and Type I PFDs. Many strap assemblies for PFDs are known in the art, such as those discussed in my previous U.S. patents, namely, U.S. Pat. Nos. 4,472,151 and 4,871,338, incorporated herein by reference, and are capable of utilization with the present invention. Preferably, however, and with reference to FIGS. 6, 7 and 13, the strap assembly 20 is structured and disposed to connect the back 16 and the front 24 of the improved float 11, together, and further, is adjustable in length so as to achieve the goal of a PFD qualifying as a "Universal Size," described previously. More in particular, the strap assembly 20 includes a girth strap 72, which may be of a single length or comprised of a plurality of sections or lengths, such that the girth strap 72 extends from one of the side surfaces, such as 35, of the front 24 and behind the float 11, meaning in the direction of the inner main surface 29 of the float 11, and connects, or interconnects as the case may be, to the swingable back 16, and then further extends to the other side surface, such as 37, of the front 24 of the float 11. The distal end zones of the girth strap 72 may then be connected together through mutually intercooperating means, such as a snap-together type buckle 78 or other type of connector structures known in the art. As the girth strap 72 is tightened about the upper body of the wearer, 2, the back 16 is drawn into a more snugged position overlaying the central zone of the back of the wearer, and the front 24 overlays the upper front torso of the wearer, as shown in FIG. 1. In effect, the girth strap 72, when snugged about the upper body of the wearer, pulls downwardly on the back 16, and preferably, generally on the end surface 51 of the back 16, which results in a reduced inner diameter partial closing of the neck opening 14.

Figure 6:
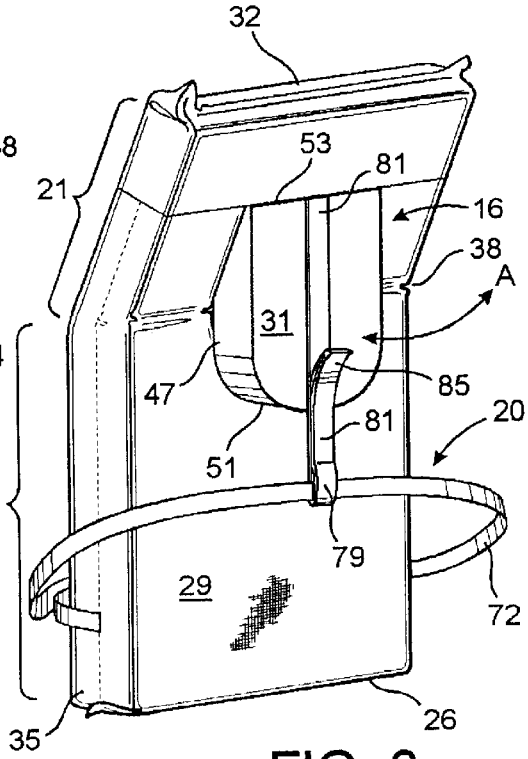
FIG. 6 is a rear perspective view of the flotation device seen in FIG. 1, illustrating a preferred strap assembly having a girth strap attached to the back of the float in a first type of connection.
Figure 7:
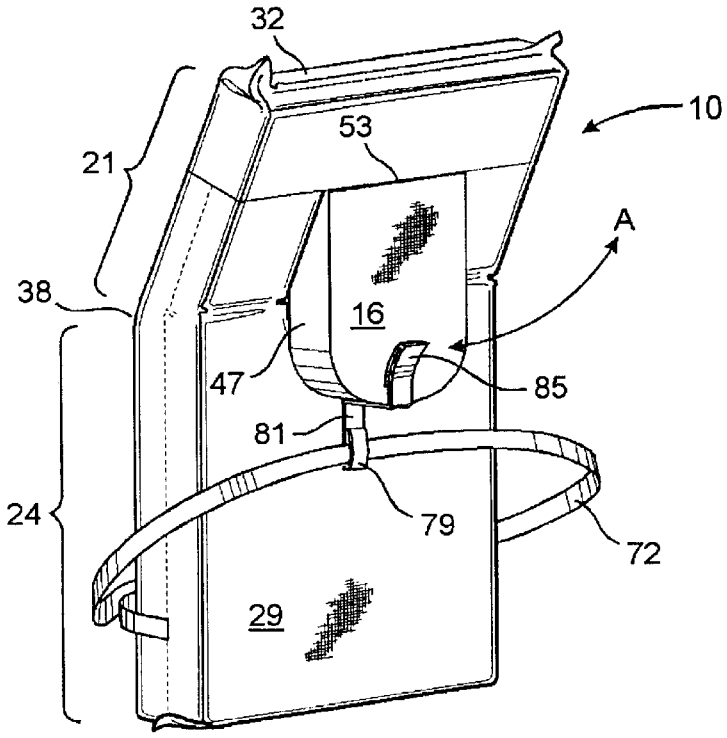
FIG. 7 is a view similar to FIG. 6 illustrating the girth strap movably attached to the back of the float in a second, alternative type of connection.

With reference to FIGS. 6, 7 and 13, the strap assembly 20 preferably also includes a loop 79 attached to the swingable end of the back 16 of the float 11. More preferably, a segment 81 of strap material is secured to the back 16 of the float 11 with the loop 79 disposed at a distal region thereof, as illustrated in FIGS. 6 and 7. The girth strap 72 preferably passes through the loop 79 such that when the strap assembly 20 is tightened about the wearer, 2, the desired downward pull on the back 16 of the float occurs. Also, the length of segment 81 can be extended beyond that shown in the drawings in order to position the girth strip 72 further down around the torso of the wearer, such as around the waist. This facilitates added lower body lift, helps to further avoid the riding up of the PFD about the neck of the wearer, and further, keeps the girth strap away from the sensitive area of the wearer's underarms. In a most preferred embodiment, the segment 81 of the strap assembly further includes a pull tab 85, formed thereon as shown in FIGS. 6, 7 and 13, which may be utilized to apply a pulling movement on the back 16 so as to move the back 16 out of the first, closed position wherein it dwells within the neck opening 14 and into another position, such as wherein the neck opening 14 is fully opened to permit the wearer to don the device, 10. This movement is partially indicated by the directional arrow, A in FIG. 6.

Figure 5:
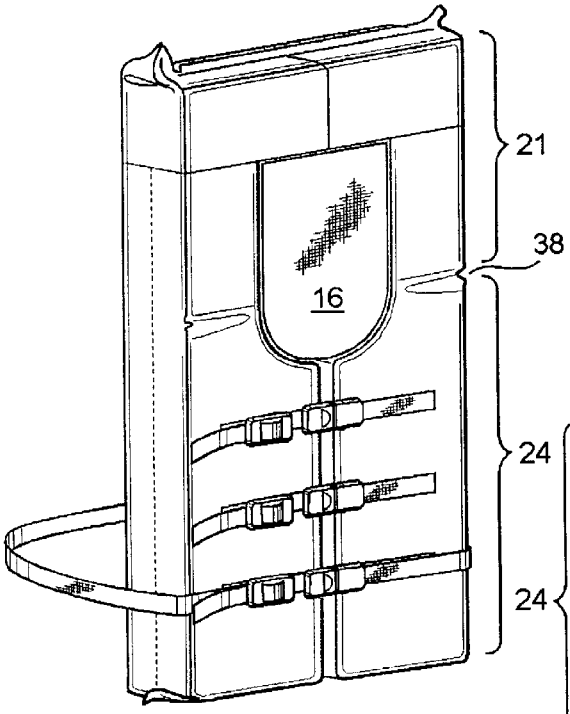
FIG. 5 is a perspective view of an alternative embodiment of the personal floatation device according to the present invention wherein the float is of a vest type.
Figure 8:
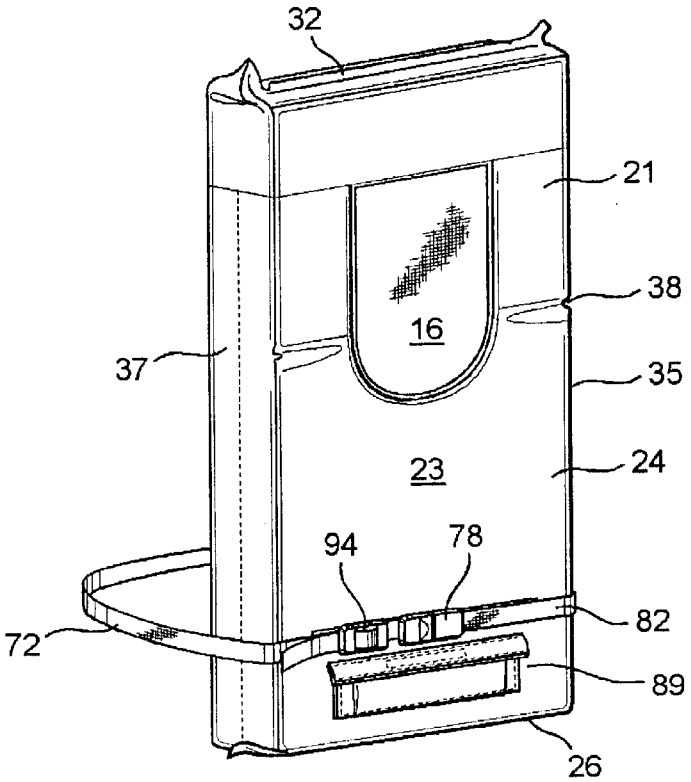
FIG. 8 is a perspective view of the embodiment shown in FIG. 1 with the front of the float slightly modified to include a pocket structure on its outside surface.

In an alternative preferred embodiment shown in FIG. 8, a length 82 of the girth strap 72 may be secured to the outer main surface 23 of the float front 24, in order to enable the wearer to readily locate the opposite distal end zone of the girth strap 72 and to mate the mutually intercooperating means, such as buckles 78, together. An alternative embodiment for the strap assembly 20 is also illustrated in FIG. 5 with reference to the present invention being incorporated into a vest or jacket type of flotation device. From the foregoing, it should be clear that the strap assembly which is utilized with the improved float 11 will preferably help to direct a person into donning the PFD in the intended manner, namely, by inserting his or her head starting from the inner main surface 29 through the neck opening in the direction of the arrow labeled "H" in FIG. 14. However, it is possible that even with a strap assembly which incorporates the preferred pull tab 85, some persons will nevertheless don the PFD in a manner which is not intended, namely by inserting his or her head starting from the outer main surface 23 in a direction opposite to the arrow labeled "H" in FIG. 14. Even this "reverse" orientation of the back of the float 11, however, will provide buoyancy to the wearer and some support to the backside of the wearer, and to the back of the wearer's head in particular, and should be sufficient to meet the criteria of at least a Type III PFD, although possibly not a Type II PFD in that the back 16 would likely not be disposed so as to reduce the inner diameter of the neck opening and prevent the PFD from being lifted off of the wearer's chin.

Figure 12:
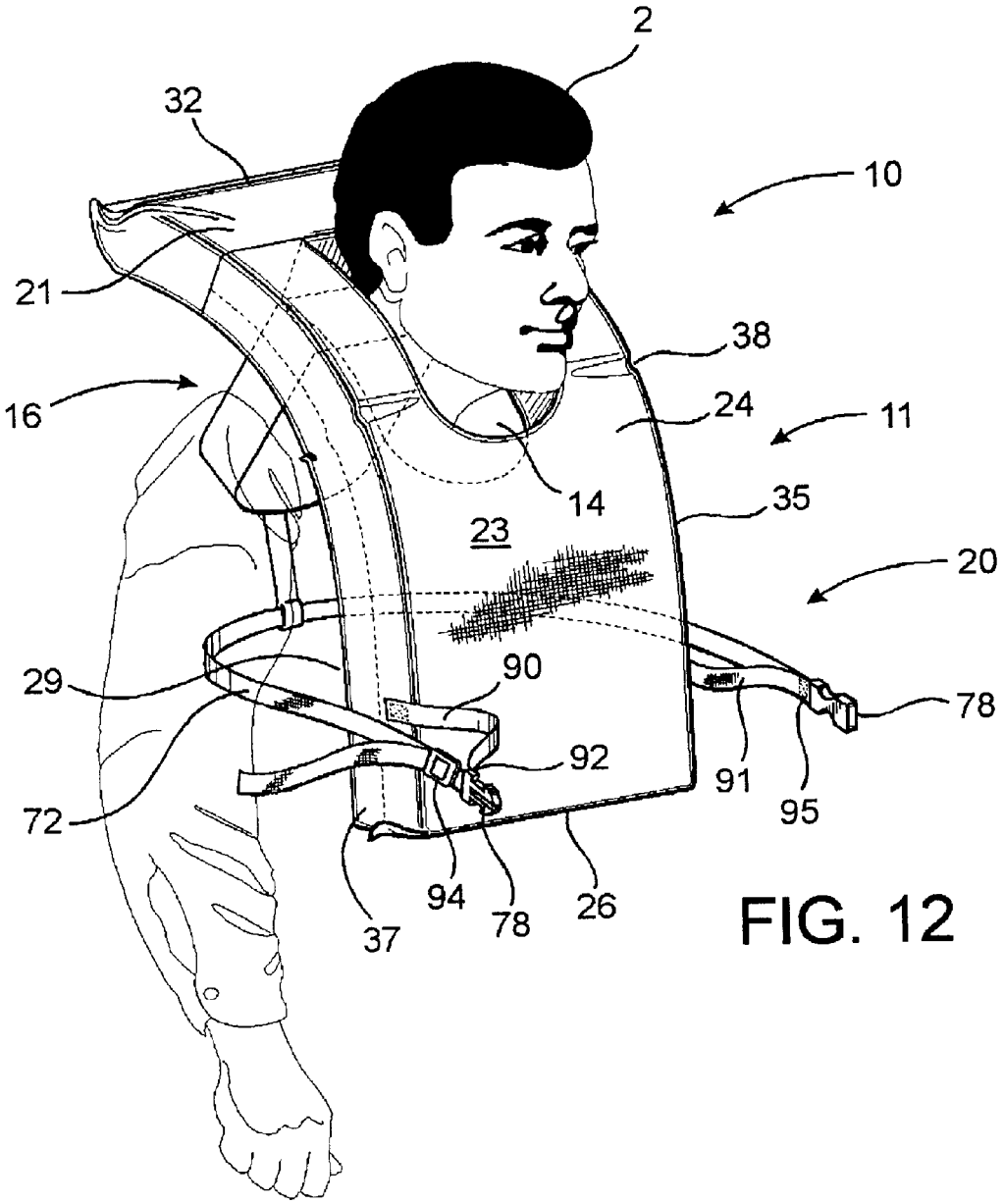
FIG. 12 is a perspective view of the flotation device seen in FIG. 1, illustrating in an unbuckled arrangement, the preferred strap assembly attached to each of the side surfaces of the front of the float, in a most preferred type of connection.

With reference now to FIGS. 12 and 13, the strap assembly 20 is illustrated in a most preferred embodiment, and in particular, is structured and disposed to facilitate the donning of the PFD in the intended manner, as explained above with reference to FIG. 14, as well as to facilitate a proper connection of the float about the wearer, comfortable use of the float as a seat cushion, and convenient stacking of a plurality of the floats 11. In this more preferred embodiment, a strap segment 90 is securely sewn at one end to one side of the float 11, such as 37, with the other end 92 having one of the mutually cooperating connecting means, such as a buckle element 78, securely disposed thereto along with an adjuster element, 94, to which the girth strap 72 may be connected. Similarly, another strap segment 91 is securely sewn at one end to the other side of the float 11, 35, with its other end 95 secured to the other one of the mutually cooperating connecting means, such as a buckle element 78. In this more preferred embodiment, the strap segments 90 and 91 are sized to jointly span the width of the float 11 between ends 35 and 37, so as to significantly facilitate the wearer's ability to mate the connecting means 78, whereupon, a single tightening or loosening adjustment of the girth strap 72 can be made utilizing adjuster element 94, for which a "ladder lock" might be used. Further, and as can be noted from FIG. 13, the strap segments 90 and 91 are preferably connected to the float 11 in a manner which makes them fold outwardly in a more visible forward position, which greatly assists with ensuring that the strap segments 90 and 91, and really, the connecting means attached thereto, will be joined together properly. One way of achieving this connection is by sewing the strap segments to the float and reinforcing them with layers of webbing, which it should be noted, also helps to limit them from being twisted or otherwise removed from the preferred visible forward position. Finally, it should also be noted that this more preferred strap assembly makes it more clear to a person as to where to put his or her arms when donning the device.

In addition, and as can be noted from FIG. 13, this strap assembly is more preferable because when the back 16 of the float 11 is moved into the second position so as to fully open the neck opening 14, the strap assembly 20 does not block or otherwise obstruct the neck opening 14, and this also facilitates a person's ability to don the device 10. Further, if the strap segments 90 and 91 are sewn or otherwise secured to the float 11 in the manner illustrated in FIG. 12, these segments are capable of being moved so as to expose the front surface 24 of the float 11, and thereby, provide a comfortable and unobstructed surface on which to sit when the device is oriented as shown in FIGS. 2-B and 2-C, which will be described shortly hereinafter.

With reference now to FIG. 8, the present invention may include some additional features, such as a pocket structure 89 which preferably, will be provided on the outer main surface 23 of the front 24 of the float 11. The provision of a pocket structure 89, while not strictly necessary, is preferred because it offers the helpful advantage of identifying the front 24 clearly to a person who may be required to don the PFD quickly in an emergency. Further, the front 24, in addition to the pocket structure 89, may include some type of indicia, such as the trademark of the PFD manufacturer, of a yacht club, of a particular designer, or the like. It is pointed out that the use of a particular designer's trademark, if well known or prestigious, might also offer the helpful advantage of enticing a person to don the PFD 10, and to continue to wear the PFD at all times while out on the water.

Another inventive and useful feature of the PFD 10 according to the present invention is that in at least one embodiment, the PFD can be converted into a comfortable seat cushion, as shown in FIGS. 2-B and 2-C, for use on the boat or another location such as at a stadium event, sporting event, parade, or the like. The preferred embodiment of the PFD 10 illustrated in FIG. 1, wherein the float 11 comprises two separate interconnected portions of buoyant material, namely, the front 24 and the head support cushion or cradle 21, which define a bendable zone 38 between them, is well suited for manipulation and orientation into a generally ninety degree (90°) angle between said portions, as illustrated in FIGS. 2-B and 2-C, whereupon, the strap assembly 20, and in particular, the girth strap 72, can be moved about the corners of the float 11 in order to maintain said position. As shown in FIG. 2-C, in this orientation, the back 16 of the float 11 is preferably oriented in generally co-planar relation to the support surface such as the bleacher seat, etc.

In use, the PFD 10 of the present invention will most likely be stored in the position shown in FIGS. 2-A and 5, that is, in a generally flat orientation, with ideally the back 16 of the float dwelling within and closing the neck opening 14. When it is needed or desired to don the PFD 10, a person will move the back 16 of the float outwardly, preferably by pulling on the pull tab 85 of the strap assembly 20, in order to swing easily the back 16 out of the position closing the neck opening 14 and into a position wherein the neck opening 14 is fully opened, preferably with the inner surface 31 of the back 16 in generally confronting relation to the inner main surface 29 of the float 11, as shown in FIG. 14. In that position, the head of a wearer may then be passed snugly through the neck opening 14 of the PFD, whereupon the girth strap 72 may then be tightened to adjust the PFD 10 snugly about the wearer's upper body. Should the wearer of the PFD 10 be forced into the water, the float 11 will exert an upward buoyant force, or lift, to the body of the wearer with the head support cushion or cradle 21 comfortably supporting the wearer's head, and importantly, without any undue pressure on the neck region of the wearer. In addition, the PFD 10 tends to orient the wearer's head in a face upward attitude and to maintain this attitude even against side-to-side forces which might otherwise urge it into a dangerous face down attitude.

While this invention has been shown in the drawings and described in several different embodiments, it is apparent that modifications can be made to the invention, and yet fall within the spirit and scope of the present invention, and as such, the invention described in the foregoing specification, and in the various drawings, and in the claims which follow, should be interpreted as being illustrative of the invention, and not in a limiting sense. As one example only, while the present invention has been described as qualifying as a "Universal Size," it would be within the spirit and scope of this invention to modify the size of it somewhat so as to qualify for other USCG approved sizes, such as an "Infant," "Child," "Youth," or even "Oversize," and the like. Thus, the scope of the invention should be determined not just by the appended claims, but also by their legal equivalents, in accordance with the well established and judicially created doctrine of equivalents.

What is claimed is:

1. A float for a personal flotation device, said float comprising:

a) a front formed of a buoyant material, said front sized to generally correspond and confront a wearer's chest and shoulder region;

b) said front including a neck opening sized and configured to permit passage of the wearer's head therethrough and defining a recess surface about said neck opening;

c) a back formed of buoyant material, said back having a first end, a second end and a body between said ends;

d) said back being movably connected to said front with said first end of said back disposed generally adjacent said recess surface and so as to reduce an inner diameter of said neck opening;

e) said back being movable between a position wherein said neck opening is opened sufficiently to permit the wearer's head to pass therethrough and another position wherein said back confronts the wearer's back region;

f) said body of said back being sized and configured to generally confront the wearer's upper and central back region and to dwell within said neck opening; and g) said back being movable into another position closing said neck opening.

2. A float for a personal flotation device, said float comprising:

a) a front formed of a buoyant material, said front sized to generally correspond and confront a wearer's chest and shoulder region;

b) said front including an aperture sized and configured to loosely confront the neck of a wearer and defining a neck confronting surface about said aperture; and c) a flap formed of buoyant material, said flap being movably connected to said front and movable between a position wherein said aperture is opened sufficiently to permit at least the wearer's neck to pass therethrough and another position wherein said flap confronts at least a portion of the wearer's backside;

d) said flap including a first end and a second end, with said first flap end movably connected and disposed generally adjacent said neck confronting surface so as to reduce an inner diameter of said aperture;

e) said flap being sized to generally confront a central, upper portion of the wearer's back; and f) said flap being movable into another position wherein said flap dwells at least partially within said aperture of said float.

3. A float as set forth in claim 2 wherein said front of said float includes a slit extending through the front from the neck opening to an end surface of the float to permit passage of the wearer's neck therethrough.

4. An improved float for a personal flotation device, said float comprising:

a) a front formed of a buoyant material sufficient to provide lift to the body of a wearer, said front sized to generally correspond and confront a wearer's chest and shoulder region;

b) said front including a head support cushion;

c) said front further including a neck opening sized to permit passage of a wearer's head therethrough; and d) a back formed of buoyant material, said back being movably connected to said front and movable between at least a first position wherein said back dwells substantially within said neck opening of said front and a second position wherein a surface of said back confronts the upper, central back region of a wearer.

5. A float as recited in claim 4 wherein said front and said head support cushion are separate members coupled together in order to define said neck opening.

6. A float as recited in claim 4 wherein said back includes a first end and a second end, with said first end of said back connected to a surface of said head support adjacent said neck opening and reducing an inner diameter of said neck opening in said second position.

7. A personal flotation device comprising:

a) a float having:

i) a front formed of a buoyant material, said front sized to generally correspond and confront a wearer's chest and shoulder region;

ii) said front having a neck opening sized and structured to permit passage of at least a wearer's neck therethrough; said neck opening including an inner float surface, and said inner float surface being sized, structured and configured to loosely confront the neck region of the wearer;

iii) a back formed of buoyant material, said back having a first end, a second end and a body between said ends; and iv) said back being movably connected to said front with said first end of said back disposed generally adjacent said inner float surface and reducing an inner diameter of said neck opening;

b) said back of said float being movable between a position wherein said neck opening is opened sufficiently to permit the wearer's head to pass therethrough and another position wherein said back confronts the wearer's back region;

c) said body of said back of said float being sized and configured to generally confront the wearer's upper, central back region and further, to dwell within said neck opening;

d) said back of said float being movable into another position closing said neck opening; and e) a strap assembly connected to said float and said back for maintaining the floatation device on the body of the wearer.

8. A personal floatation device as set forth in claim 7 wherein said strap assembly includes a pull tab connected to said back.

9. A personal floatation device as recited in claim 7 wherein said strap assembly includes a girth strap interconnecting said front of said float and said back.

10. A personal floatation device as recited in claim 9 wherein a first end of said girth strap is secured to said float at a first side portion, and wherein said girth strap is movably yet reliably connected to a connector and adjuster element, said connector and adjuster element mating with a connector element disposed on a strap segment secured to an opposite portion of said float and permitting adjustment of the overall length of said girth strap.

11. A personal floatation device as set forth in claim 10 wherein said strap assembly further comprises a loop structure disposed at said back of said float, and said girth strap slidably passes through said loop.

12. A personal floatation device as set forth in claim 9 further comprising a first strap segment connected to a first side surface of said float and a second strap segment connected to a second side surface of said float, said first and second strap segments each being sized to span generally about one-half of a distance between said first and second side surfaces of said float, and including a connector element to join said strap segments together.

13. A personal floatation device as set forth in claim 12 wherein one of said first or second strap segments includes an adjuster element and said girth strap connects at one end to said adjuster element such that the overall length of said girth strap can be adjusted, with said other end of said girth strap being fixedly connected to the other of said strap segments.

14. A personal floatation device as set forth in claim 13 wherein said strap assembly further comprises a segment attached to said back of said float with a loop formed at a free distal end of said segment, and said girth strap disposed to slidably pass through said loop.

15. A personal floatation device as set forth in claim 14 wherein said strap assembly includes a pull tab connected to said back for facilitating movement of said back out of said position wherein said back dwells within and closes said neck opening.

16. A personal floatation device comprising:

a) a float having sufficient buoyancy to provide at least 15 and ½ pounds-force of buoyancy to a wearer of the floatation device; said float having an outer and an inner main surface, a first and a second spaced end surface, and a pair of spaced side surfaces;

b) said float further comprising:

i) a front extending a first distance from the first end surface toward the second end surface, and ii) a head cradle extending a second distance from the second end surface towards said front, c) said inner main surface of said front being sized and configured to confront the upper front torso of the wearer, d) said float having a neck opening disposed between said spaced side surfaces, with a portion of said neck opening in said front and a portion of said neck opening in said head cradle, said neck opening sized and configured to loosely confront the neck of the wearer, e) a back including a first end, a second end, spaced side surfaces between said ends, and an inner surface, an outer surface, said back being sized and configured to dwell within, and at least partially to occupy said neck opening within said float when in a first position, f) said back being swingably connected to said float to accommodate swinging movement from said first position toward a second position wherein said neck opening is fully open with said inner surface of said back confronting said inner main surface of said float corresponding to said head cradle, and into a third position with said outer surface of said back generally confronting the wearer's upper back region;

g) said front of said float having a volume which is greater than a volume of said back in order to tend to move the wearer of the floatation device while in water into a face-up attitude with the wearer's head oriented, supported and cradled in said attitude by said back and said head cradle, and h) a strap assembly to connect said float to the wearer.

17. A float as recited in claim 16 wherein said back is connected at said first end adjacent said inner surface to said head cradle of said float adjacent said neck opening, said back reducing an inner diameter of said neck opening in said third position.

18. A personal floatation device as set forth in claim 16 wherein said first distance is greater than said second distance.

19. A personal floatation device as set forth in claim 16 wherein said float has a generally parallelepipedal configuration and said buoyant material comprises a closed cell foam material.

20. A personal floatation device as set forth in claim 16, wherein said front and said head cradle are formed of a single piece of buoyant material.

21. A personal floatation device as set forth in claim 16 wherein said front and head cradle are each formed from a separate piece of a common buoyant material with said front and said head cradle joined together and being at least partially movable relative to each other.

22. A personal floatation device as set forth in claim 21 wherein a jacket of flexible, bendable material is provided about said float.

23. A personal floatation device as set forth in claim 22 wherein said float is bendable between said front and said head cradle to form an angle of generally about ninety degrees.

24. A personal floatation device as set forth in claim 16 wherein said float includes a pocket structure on said outer main surface.

25. A personal floatation device as set forth in claim 24 wherein said outer main surface of said front float includes indicia.

26. A float as set forth in claim 16 a wherein said front of said float includes a slit extending through the front from the neck opening to and through said first end surface of the float so that the float may be worn as a jacket.

* * * * *